US005855492A

United States Patent [19]

Abe et al.

[11] Patent Number: 5,855,492

[45] Date of Patent: Jan. 5, 1999

[54] PRESS-CONNECTING JOINT CONNECTOR

[75] Inventors: Kimihiro Abe; Toshiaki Okabe, both of Shizuoka, Japan

[73] Assignee: Yazaki Corporation, Tokyo, Japan

[21] Appl. No.: 619,979

[22] Filed: Mar. 20, 1996

[30] Foreign Application Priority Data

Mar. 23, 1995 [JP] Japan ..... 7-064402
Sep. 5, 1995 [JP] Japan ..... 7-228168

[51] Int. Cl.[6] ..... H01R 4/24

[52] U.S. Cl. ..... 439/417; 439/409; 439/459

[58] Field of Search ..... 439/417, 398, 439/402, 403, 404, 409, 449, 501, 459

[56] References Cited

U.S. PATENT DOCUMENTS

| | | | |
|---|---|---|---|
| 3,388,370 | 6/1968 | Elm | 439/402 |
| 4,274,696 | 6/1981 | Long et al. | 439/395 |
| 4,413,871 | 11/1983 | Swengel, Jr. | 439/402 |
| 4,830,625 | 5/1989 | Vignoli | 439/404 |
| 4,993,961 | 2/1991 | Hisatomi et al. | 439/501 |

FOREIGN PATENT DOCUMENTS

| | | | |
|---|---|---|---|
| 2314330 C2 | 7/1983 | Germany . | |
| 52-1493 | 1/1977 | Japan | 439/449 |
| 58-214283 | 12/1983 | Japan . | |
| 1-146466 | 10/1989 | Japan . | |

*Primary Examiner*—Gary F. Paumen
*Assistant Examiner*—Tho Dac Ta
*Attorney, Agent, or Firm*—Morgan, Lewis and Bockius LLP

[57] ABSTRACT

A press-connecting joint connector comprises a terminal having a plurality of electrically connected press-connecting blades for electrically connecting a plurality of sheathed wires pressed into the press-connecting blades, a connector body for supporting the terminal therein, the connector body having at least one side wall, a cover, a wire-pressing portion formed on the cover for pressing the wires into the press-connecting blades when the cover is engaged with the connector body, and a notched portion formed in at least one longitudinal end of the at least one side wall of the connector body, wherein at least one of the plurality of wires, when bent, is received by and held against the notched portion to prevent the cover from being disengaged from the connector body by an external force acting on the at least one of the plurality of wires.

15 Claims, 7 Drawing Sheets

PRESS-CONNECTING JOINT CONNECTOR

BACKGROUND OF THE INVENTION

1. Field of the Invention

The present invention relates to a press-connecting joint connector, and more particularly, to a press-connecting joint connector for electrically connecting a plurality of wires together.

2. Discussion of the Related Art

Various press-connecting joint connectors have been proposed for electrically connecting a plurality of wires. One example of a conventional press-connecting joint connector is disclosed in Japanese Unexamined Patent Publication No. 58-214283.

FIG. 12 shows an exploded perspective view of a conventional press-connecting joint connector 51. The conventional press-connecting joint connector 51 comprises a terminal 56 made of a metal plate, a strain reduction member 61, a cover 66, and a connector body 63.

The terminal 56 includes a pair of right and left press-connecting blades 53 and 54 juxtaposed at a pitch P1 for electrically connecting two sheathed wires 5 together. The terminal 56 also includes a relief groove 55 formed in a central portion of the terminal 56.

The strain reduction member 61 includes an upstanding cutting plate 58 having a sharp cutting edge at an upper portion thereof, and a strain reduction portion 60 having a pair of end walls 59 disposed parallel to the cutting plate 58. The terminal 56 is held at its tabs 57 by the cutting plate 58.

The cover 66 includes retaining projections 64 and wire receiving grooves 65 at its lower side.

The connector body 63 includes retaining ribs 67 for respectively engaging the retaining projections 64, an upwardly-openable lid 62 pivotally mounted on the connector body 63 for movement between an open and a closed position, and a body cavity for holding the terminal 56 and the strain reduction member 61. A holder groove 68 for holding the terminal 56 is inside the body cavity of the connector body 63.

In the above construction, the strain reduction member 61 is first fitted into the connector body 63, and the terminal 56 is then held in the holder groove 68. Next, the wires 5 are placed in the wire receiving grooves 65, and the cover 66 is press-fitted into the connector body 63 from the top to hold the wires 5 inside the connector body 63. As a result, the wires 5 are cut by the cutting plate 58, and the sheaths of the wires 5 are cut respectively by the press-connecting blades 53 and 54 of the terminal 56. This allows the conductor part of the wires 5 to contact respective ones of the press-connecting blades 53 and 54, so that the wires 5 are electrically connected together. After the retaining projections 64 are engaged with the retaining ribs 67, the lid 62 is pivotally moved into its closed position, and is held in this position by the connector body 63.

Problems associated with the above conventional press-connecting joint connector are as following. As shown in FIG. 13, when the two wires 5 are laterally bent away from each other so that pulling forces with vertical components are exerted on the wires 5, each wire is forced into a gap between the side wall of the connector body 63 and the cover 66. This causes the cover 66 to disengage from the connector body 63.

In addition, as shown in FIG. 12, since the relief groove 55 is formed between the press-connecting blades 53 and 54, the pitch P1 is increased by an amount corresponding to the width of the relief groove 55. This prevents the connector from having a compact design.

SUMMARY OF THE INVENTION

Accordingly, the present invention is directed to a press-connecting joint connector that substantially obviates one or more of the problems due to limitations and disadvantages of the related art.

An object of the present invention is to provide a press-connecting joint connector in which a cover is prevented from being disengaged by laterally-bent wires. Another object is to provide a press-connecting joint connector with a compact design.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the invention, as embodied and broadly described, the press-connecting joint connector of the present invention includes a terminal having a plurality of electrically connected press-connecting blades for electrically connecting a plurality of sheathed wires pressed into the press-connecting blades, a connector body for supporting the terminal therein, the connector body having at least one side wall, a cover, a wire-pressing portion formed on the cover for pressing the wires into the press-connecting blades when the cover is engaged with the connector body, and a notched portion formed in at least one longitudinal end of the at least one side wall of the connector body, wherein at least one of the plurality of wires, when bent, is received by and held against the notched portion to prevent the cover from being disengaged from the connector body by an external force acting on the at least one of the plurality of wires.

In another aspect, the press-connecting joint connector of the present invention includes a connector body having at least one side wall, a terminal supported by the connector body and including at least one press-connecting blade, a cover engaged with the connector body, and a notched portion formed in at least one end of the at least one side wall.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
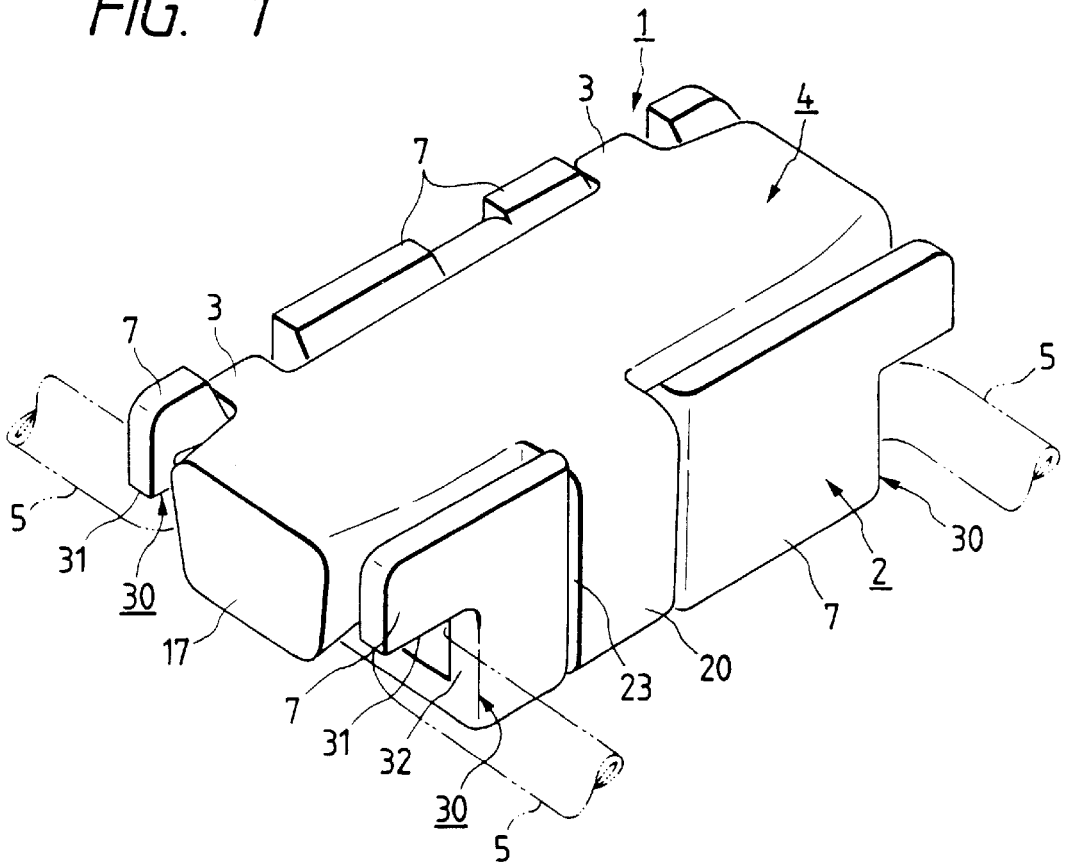
FIG. 1 is a perspective view of a first embodiment of a press-connecting joint connector of the present invention in its assembled condition.

A first preferred embodiment of the present invention will now be described in detail with reference to FIGS. 1 through 4. As shown in FIG. 1, the press-connecting joint connector 1 comprises a connector body 2 formed of a synthetic resin, and a cover 4 pivotally connected to the connector body 2 by hinges 3.

Figure 2:
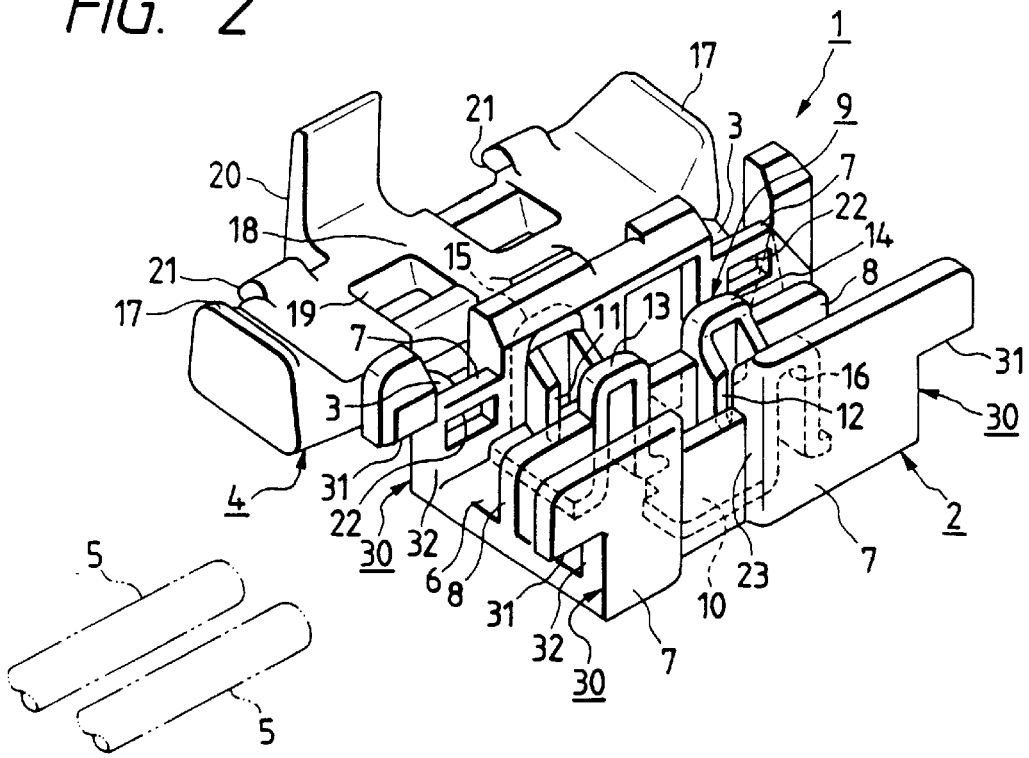
FIG. 2 is a perspective view of the connector of FIG. 1 with the cover held in its open condition.

As shown in FIG. 2, the connector body 2 includes two upright side walls 7 integrally formed on a bottom wall 6, intermediate walls 8 integrally formed centrally within the connector body 2 and parallel to the side walls 7, inverted L-shape notches 30 formed in at least one (both in this embodiment) end of each of the side walls 7, and a terminal 9 formed in spaces defined by the bottom wall 6, the side walls 7 and the intermediate wall 8. The inverted L-shape notches 30 have a horizontal surface 31 and a vertical surface 32. The terminal 9 is either molded on the connector body 2, or fitted into the connector body 2.

Figure 3:
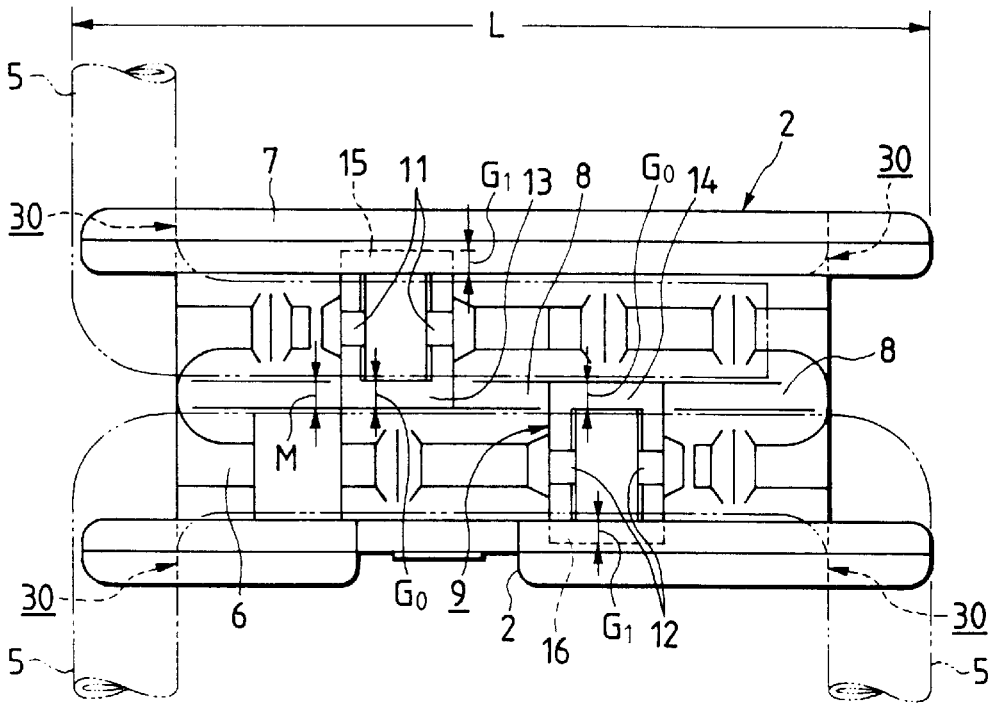
FIG. 3 is a plan view of a connector body in the condition of FIG. 2.
Figure 4:
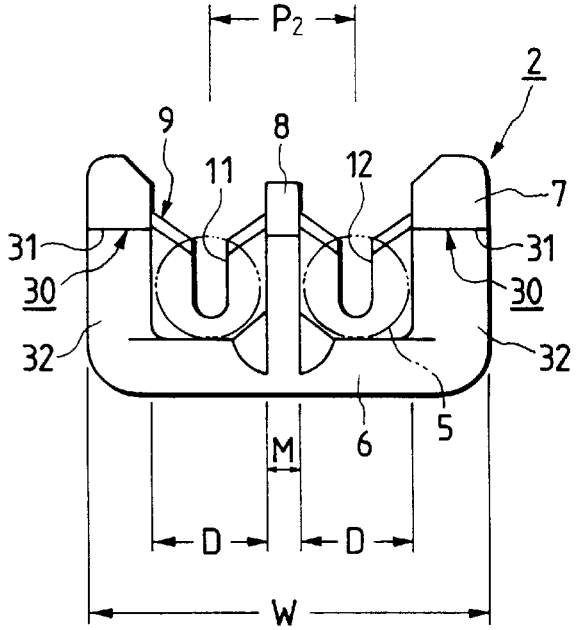
FIG. 4 is a side-elevational view of the connector body of FIG. 3.

The terminal 9 has two press-connecting blades 11 and 12 extending upright from a bottom plate 10, the two blades 11 and 12 being arranged in a staggered manner. Blade 11 has an inner end portion 13 and an outer end portion 15. Blade 12 has an inner end portion 14 and an outer end portion 16. The inner end portion 13 and the inner end portion 14 are disposed in a common plane, i.e. the same plane in which the intermediate walls 8 are disposed. Each of the inner end portions 13 and 14 is held between the intermediate walls 8. The thickness M (see FIGS. 3 and 4) of the intermediate wall 8 is equal to the width $G_o$ of the inner end portions 13 and 14. As shown in FIGS. 2 through 4, the outer end portions 15 and 16 have a width $G_1$ so that they are embedded in the opposite side walls 7, respectively. The distance D (see FIG. 4) between the intermediate wall 8 and the side wall 7 is equal to the outer diameter of a sheathed wire 5.

As shown in FIGS. 1 and 2, the cover 4 includes wire-pressing portions 17, a reverse surface 18, retaining projections 21, and a side lid 20.

The wire-pressing portions 17 are formed at and project from opposite ends of the cover 4. The reverse surface 18 of the cover 4 presses the wires 5 down when the cover 4 is in a closed position. The retaining projections 21 are formed at the four corner portions of the cover 4 to engage with retaining holes 22 formed in the inner surfaces of the side walls 7 to thereby secure the cover 4 onto the connector body 2. The side lid 20 is formed on the cover 4, and can be fitted in an opening 23 formed in the side wall 7.

In the press-connecting joint connector 1 of the above construction, the two wires 5 are first pressed respectively into the press-connecting blades 11 and 12 from the top of the connector body 2. This can be performed either by a tool, or by the reverse surface 18 and the wire-pressing portions 17 when the cover 4 pivotally moves about the hinges 3. As a result, the sheath of each wire 5 is cut, the conductor part of the wires are brought into contact with the press-connecting blade 11 and 12, and the two wires 5 are electrically connected together. Then, the cover 4 is held securely to the connector body 2 by engaging the retaining projections 21 in the respective retaining holes 22 formed in the side wall 7. This completes the assembling of the press-connecting joint connector 1.

When the two wires 5 are laterally bent away from each other in such a manner that each wire is held against the vertical surface 32 and horizontal surface 31 of the respective notches 30, the vertical component of the resultant force merely urges the horizontal surface 31 upwardly. Since the cover 4 is held securely to the connector body 2, this design enhances the reliability of the connector.

A second embodiment of the present invention will now be described in detail with reference to FIGS. 5 through 8. This second embodiment differs from the first embodiment in that a slanting surface 31*a*, instead of a horizontal surface, is formed on each of the notch portions 30*a*. The other portions of the second embodiment are identical to those of the first embodiment and are designated by identical reference numerals, and, therefore, an explanation of those other portions will be omitted.

Figure 5:
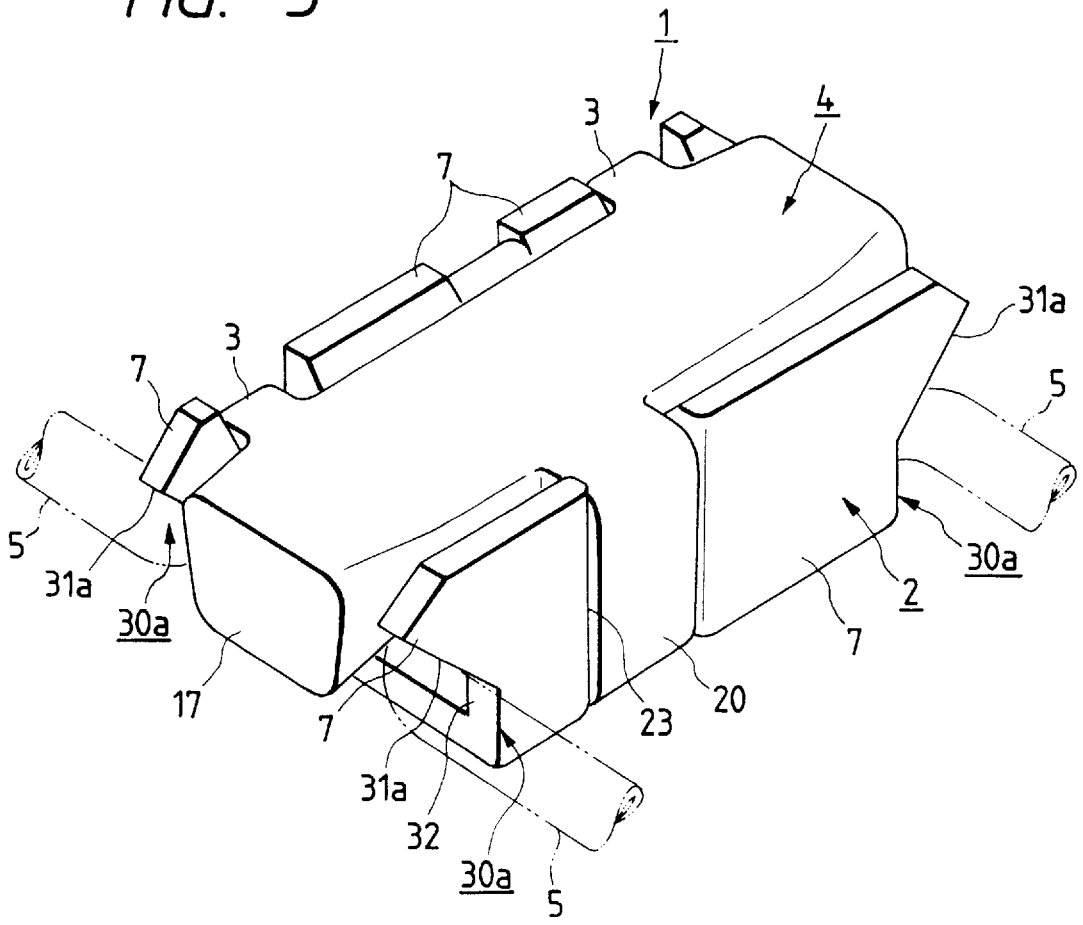
FIG. 5 is a perspective view of a second embodiment of a press-connecting joint connector of the invention in its assembled condition.
Figure 6:
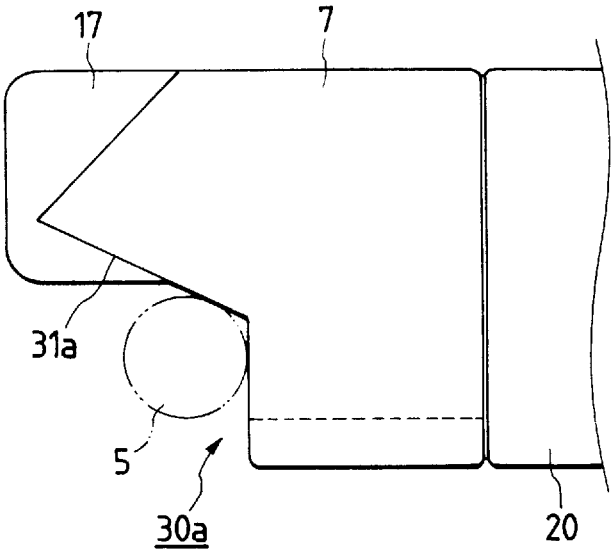
FIG. 6 is an enlarged side-elevational view showing a notch in the connector of FIG. 5.
Figure 7:
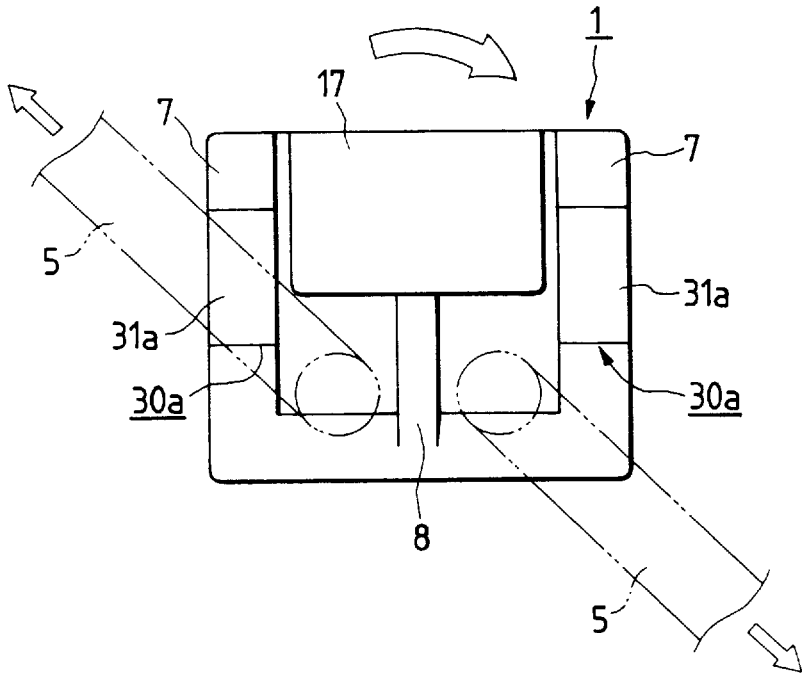
FIG. 7 is a view showing an initial stage of the operation of the connector of FIG. 5.

In the press-connecting joint connector of the second embodiment, each of the notches 30*a* is defined by a vertical surface 32 and a slanting surface 31*a* as shown in FIGS. 5 and 6, providing an obtuse notch space. When the cover 4 is pivotally moved about hinges 3 to fit on the connector body 2 as shown in FIG. 5, the two wires 5 are pressed by wire-pressing portions 17 and the reverse surface 18 of the cover 4. When the two wires 5 are laterally bent away from each other, each is held against the vertical surface 32 and the slanting surface 31*a* of the respective notch 30*a*.

When a pulling force with an upward and downward component (i.e., a moment) acts on the two wires 5, the wires 5 slide over the respective slanting surfaces 31*a*. This causes the entire connector 1 to rotate around a longitudinal axis as indicated by the arrow in FIG. 7. More specifically, the upward and downward force components act on the wires 5, causing the rotation of the connector 1. In other words, a pulling force acting in a direction which would cause the disengagement of the cover in the conventional connector, is converted into a rotational force in the present invention.

Figure 8:
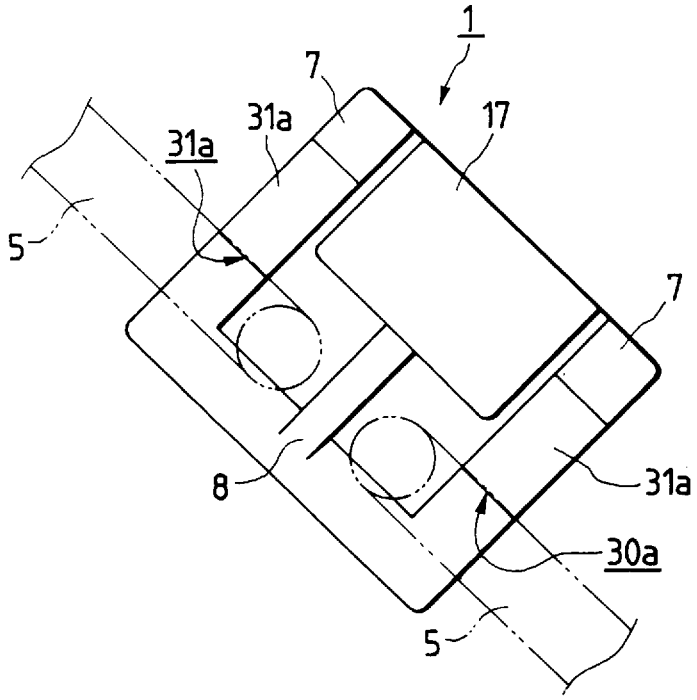
FIG. 8 is a view showing a condition in which the operation of FIG. 7 is completed.

As a result, the connector 1 rotates while the directions of the pulling force via the wires 5 remain unchanged as shown in FIG. 8. Each of the two wires 5 is then returned to a proper position in the respective notch 30*a*, and is held stably. Since the disengagement of the cover 4 from the connector body 2 is prevented, the reliability of the connector is enhanced.

Figure 9:
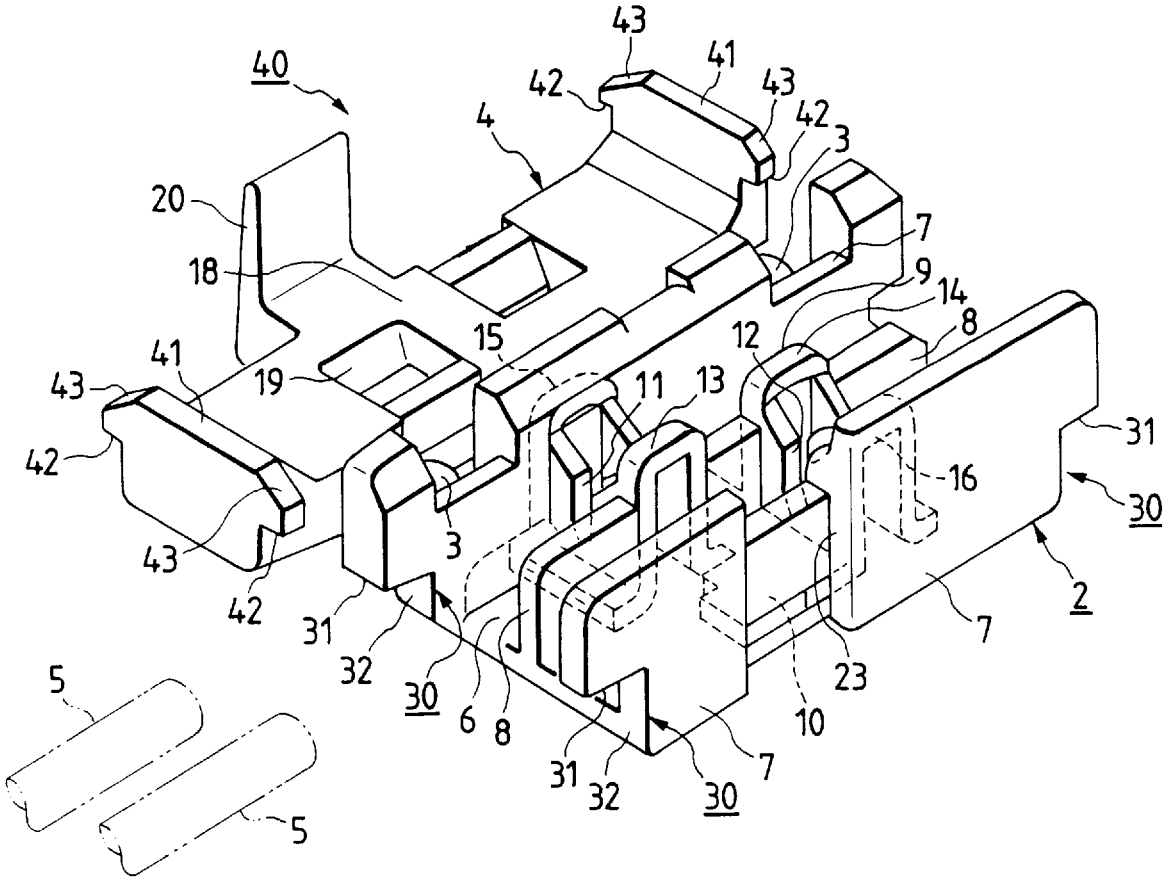
FIG. 9 is a perspective view of a third embodiment of a press-connecting joint connector of the invention with the cover held in its open condition.
Figure 10:
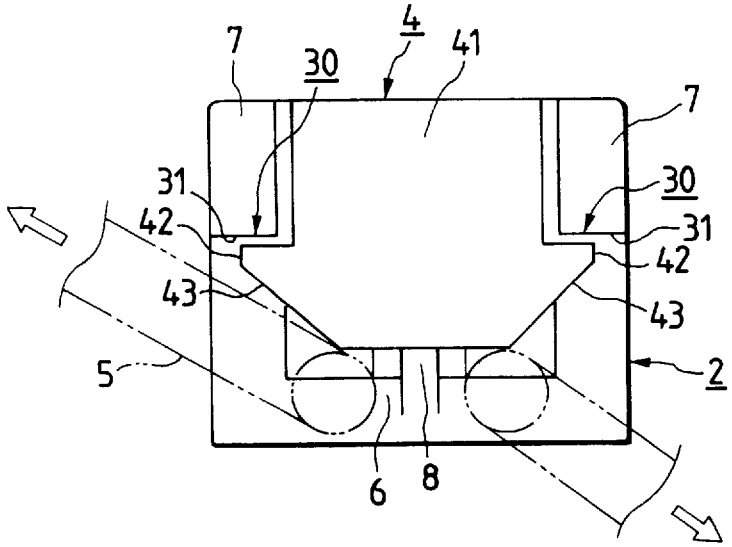
FIG. 10 is a view showing the operation of the connector of FIG. 9.

A third embodiment of a press-connecting joint connector of the invention will now be described in detail with reference to FIGS. 9 and 10. This third embodiment differs from the first embodiment in that wire-pressing portions 41 of the third embodiment are shaped differently than the wire-pressing portions 17 of the first embodiment. Specifically, retaining locks 42 are formed on opposite ends of each wire-pressing portion 41. In addition, inclined surfaces 43 are formed on opposite ends and along a lower surface of the wire-pressing portion 41. The inclined surfaces 43 guide the wires 5 when the wires 5 are laterally and upwardly pulled. The other portions of the third embodiment are identical to those of the first embodiment and are designated by identical reference numerals, and, therefore, an explanation of those other portions will be omitted.

In the press-connecting joint connector 40 of the third embodiment, when the cover 4 is pivotally moved about hinges 3 to fit on the connector body 2, the wires 5 are pressed by the wire-pressing portions 41 and the reverse surface 18 of the cover 4. As a result, the retaining locks 42 are firmly engaged with the horizontal surfaces 31 of the notched portions 30 (see FIG. 10).

When the wires 5 are bent laterally away from each other and pulled laterally and upwardly, each inclined surface 43 guides the respective wire 5 to thereby accommodate an upward component force acting on the wire-pressing portion 41. When the wire 5 is held against the notched portion 30, the corresponding side wall 7 is urged inwardly, so that the retaining lock 42 is locked more firmly. Therefore, this design enhances the reliability of the connector.

Figure 11:
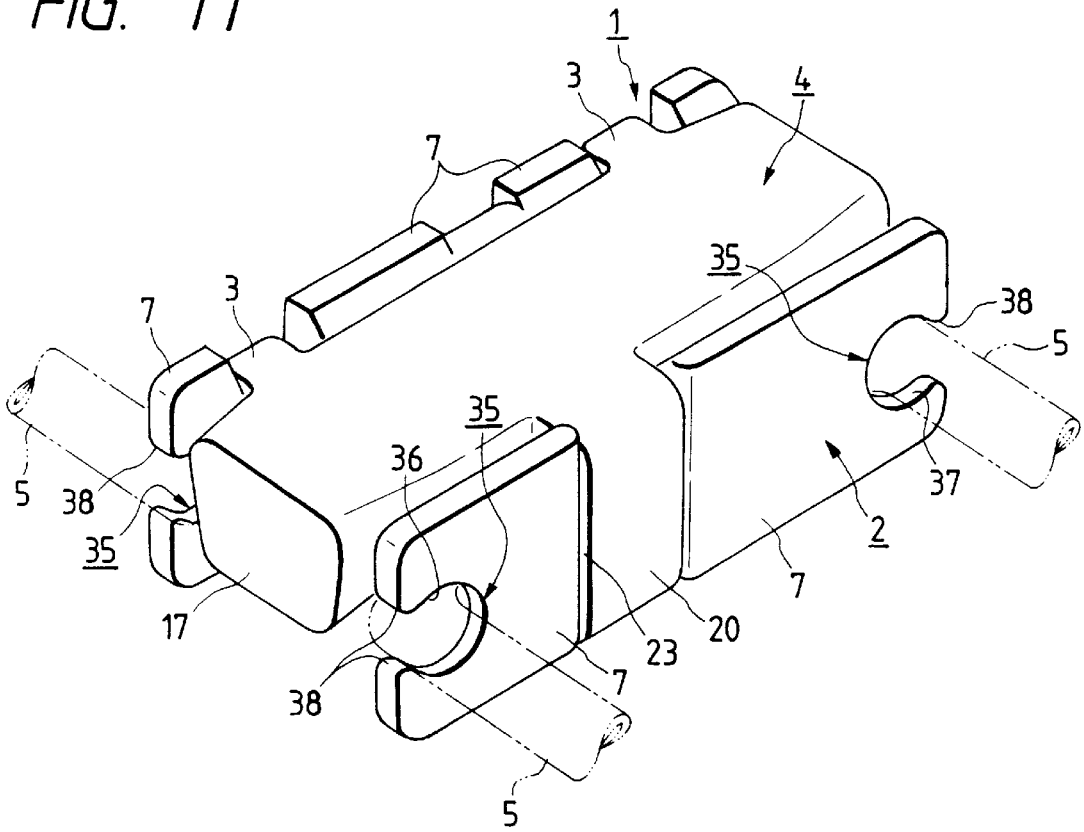
FIG. 11 is a perspective view of an additional embodiment of a press-connecting joint connector of the invention in its assembled condition.
Figure 13:
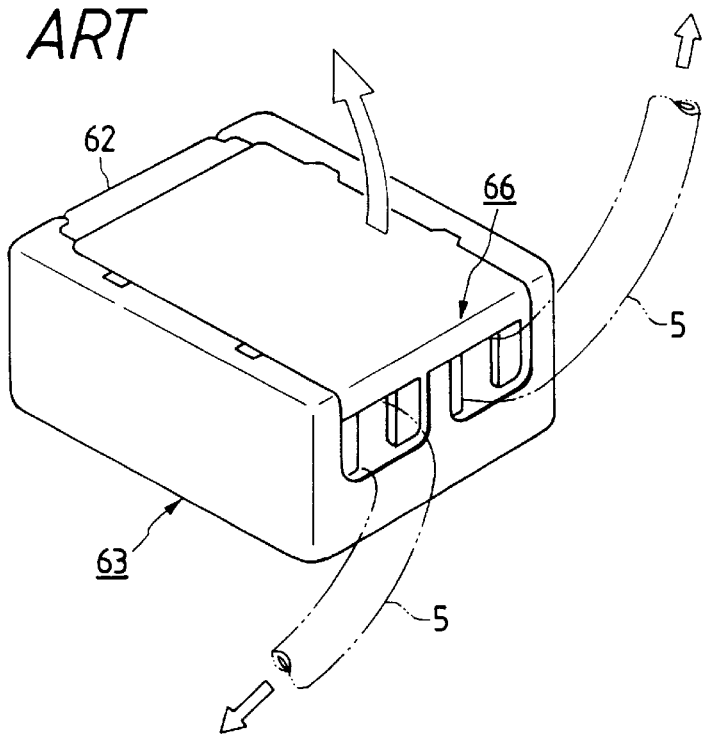
FIG. 13 PRIOR ART
FIG. 13 is a view showing the operation of the connector of FIG. 12.
Figure 12:
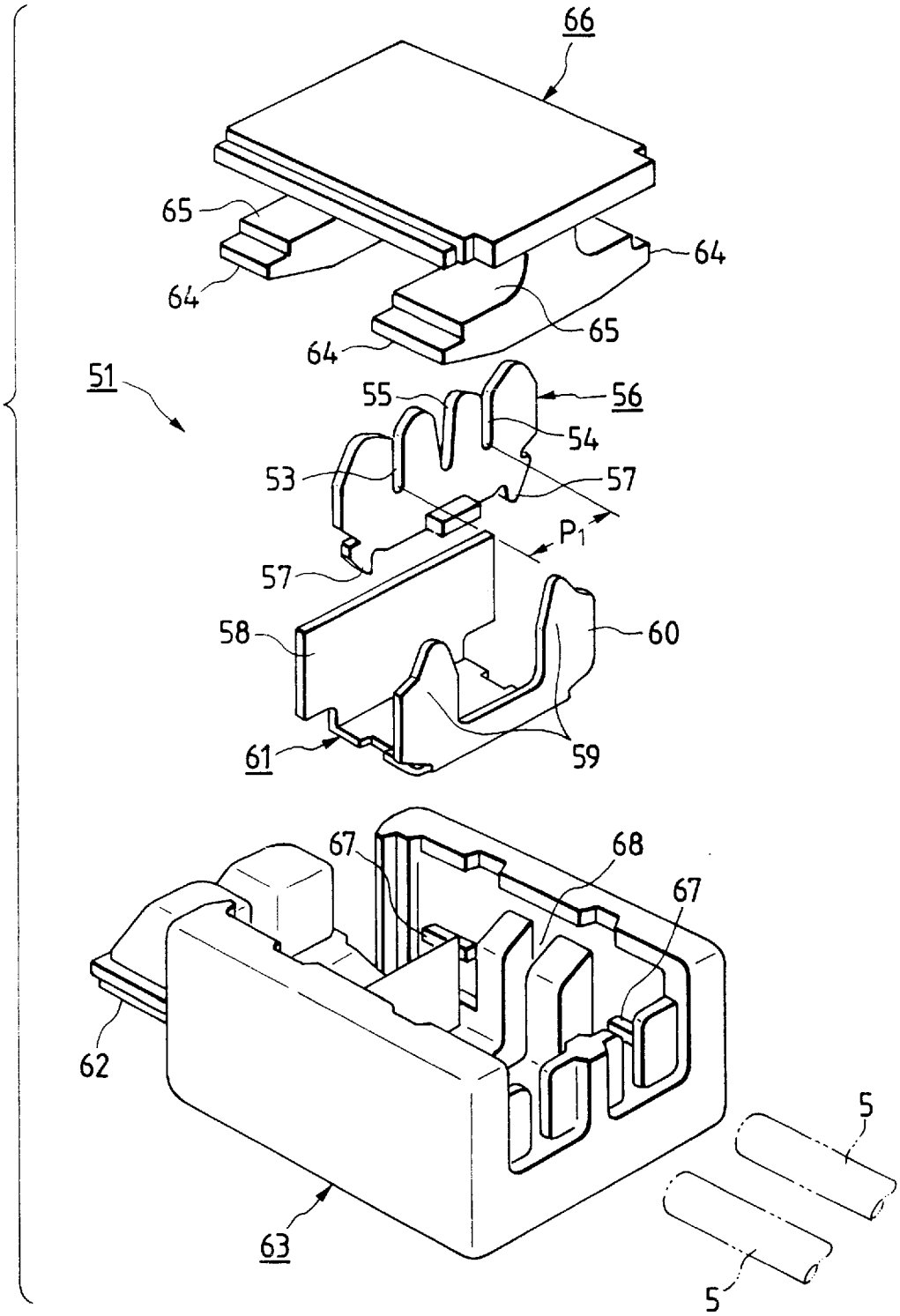
FIG. 12 PRIOR ART
FIG. 12 is an exploded, perspective view of a conventional press-connecting joint connector.

The present invention is not to be limited to the above embodiments, and various suitable modifications can be made. For example, more than two press-connecting blades can be used to electrically connect a plurality of sheathed wires together. Another possible modification is shown in FIG. 11 where the inverted L-shape notches 30 in the first embodiment may be replaced by circular shape notches 35 having a constricted opening 38. With this design, the bent portions of the laterally-bent wires 5 are stably seated. In addition, a longitudinal expansion of the wires 5 due to a residual elastic force is prevented by the constricted opening 38. This further stabilizes the position of the wires 5.

The following are some advantages of the present invention. Since the plurality of press-connecting blades are arranged in a staggered manner, they can be bent individually without interfering with each other. Therefore, the connector of the present invention has a prolonged life-time and enhanced reliability.

In addition, three features of the present invention promote a more compact design compared to the conventional connector. First, since the inner end portions 13 and 14 of the adjacent press-connecting blades 11 and 12 are disposed in a common plane in juxtaposed relation to each other, the width of the terminal 9 is reduced. Consequently, the pitch P2 of the wires 5 can be reduced (see FIG. 4). Second, since the outer end portions 15 and 16 of the press-connecting blades 11 and 12 are embedded in the side walls 7, the width W (see FIG. 4) of the connector body 2 is reduced. Finally, when the two wires are laterally bent in opposite directions, the notches 30 on the side walls 7 generally embrace the two wires. As a result, the longitudinal length L (see FIG. 3) including the wires is reduced. Thus, the connector of the present invention is more compact than the conventional connector.

Moreover, in the press-connecting joint connector of the present invention, the notched portions with various shapes are formed in at least one longitudinal end of each of the opposite side walls of the connector body. Each of the wires, when bent, can be received by and held against the respective notched portion so as to prevent the cover from being disengaged by an external force acting on the wires. This greatly enhances the reliability of the connector.

It will be apparent to those skilled in the art that various modifications and variations can be made in the press-connecting joint connector of the present invention without departing from the spirit or scope of the invention. Thus, it is intended that the present invention cover the modifications and variations of this invention provided they come within the scope of the appended claims and their equivalents.

What is claimed is:

1. A press-connecting joint connector comprising:

a terminal having a plurality of electrically connected press-connecting blades for electrically connecting a plurality of sheathed wires pressed into the press-connecting blades;

a connector body for supporting the terminal therein, the connector body having at least one side wall;

a cover;

a wire-pressing portion formed on the cover for pressing the wires into the press-connecting blades in a first direction when the cover is engaged with the connector body; and a notched portion formed in at least one longitudinal end face of the at least one side wall of the connector body, wherein at least one of the plurality of wires, when bent, is received by and held against the notched portion to prevent the at least one of the plurality of wires from moving in a direction opposite to the first direction, thereby preventing the cover from being disengaged from the connector body by an external force acting on the at least one of the plurality of wires.

2. The press-connecting joint connector according to claim 1, wherein the notched portion has a slanting surface for holding the at least one of the plurality of wires.

3. The press-connecting joint connector according to claim 1, wherein the notched portion has a circular shape with a constricted opening.

4. The press-connecting joint connector according to claim 1, wherein the notched portion has an inverted L-shape with a horizontal surface for holding the at least one of the plurality of wires.

5. The press-connecting joint connector according to claim 4, further comprising:

a retaining lock formed on an end of the wire-pressing portion, the retaining lock being engageable with the horizontal surface of the notched portion; and an inclined surface for guiding the at least one of the plurality of wires obliquely upwardly, the inclined surface being formed on a lower surface of the wire-pressing portion and disposed at an end thereof.

6. A press-connecting joint connector comprising:

a connector body having at least one side wall;

a terminal supported by the connector body and including at least one press-connecting blade;

a cover engaged with the connector body;

at least one wire-pressing portion formed on the cover for pressing a wire into the press-connecting blade in a first direction; and a notched portion formed in at least one longitudinal end face of the at least one side wall for preventing the wire from moving in a direction opposite to the first direction.

7. The press-connecting joint connector according to claim 6, wherein when a wire is pressed into the at least one press-connecting blade and an external force is acting on the wire, the notched portion prevents the wire from disengaging the cover from the connector body.

8. The press-connecting joint connector according to claim 6, wherein the notched portion has an inverted L-shape.

9. The press-connecting joint connector according to claim 6, further comprising:

a retaining lock formed on an end of the wire-pressing portion, the retaining lock being engageable with a horizontal surface of the notched portion; and an inclined surface for guiding the wire obliquely upwardly, the inclined surface being formed on a lower surface of the wire-pressing portion and disposed at an end thereof.

10. The press-connecting joint connector according to claim 6, wherein the terminal includes a plurality of press-connecting blades arranged in a staggered manner.

11. The press-connecting joint connector according to claim 6, further comprising:

a plurality of retaining holes disposed in the at least one side wall of the connector body; and a plurality of retaining projections disposed on the cover to engage with respective ones of plurality of retaining holes.

12. The press-connecting joint connector according to claim 6, wherein the notched portion has a slanting surface and a vertical surface.

13. The press-connecting joint connector according to claim 12, wherein an obtuse notch space is provided between the slanting surface and the vertical surface.

14. The press-connecting joint connector according to claim 6, wherein the notched portion has a circular shape.

15. The press-connecting joint connector according to claim 14, wherein the notched portion further has a constricted opening.

* * * * *